US009512753B2

(12) United States Patent
Han

(10) Patent No.: US 9,512,753 B2
(45) Date of Patent: Dec. 6, 2016

(54) COOLING APPARATUS AND COOLING CONTROL METHOD FOR EGR GAS AND ENGINE OIL

(71) Applicant: Hyundai Motor Company, Seoul (KR)

(72) Inventor: Jung Jae Han, Gwangmyeong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 257 days.

(21) Appl. No.: 14/079,537

(22) Filed: Nov. 13, 2013

(65) Prior Publication Data

US 2015/0040875 A1 Feb. 12, 2015

(30) Foreign Application Priority Data

Aug. 12, 2013 (KR) ..... 10-2013-0095238

(51) Int. Cl.
*F01M 5/00* (2006.01)
*F01P 3/20* (2006.01)

(52) U.S. Cl.
CPC ..... *F01M 5/005* (2013.01); *F01M 5/001* (2013.01); *F01P 3/20* (2013.01); *F02M 26/30* (2016.02); *F01P 2060/04* (2013.01); *F02M 26/13* (2016.02); *F02M 26/22* (2016.02); *F02M 26/25* (2016.02)

(58) Field of Classification Search
CPC .... F01M 5/005; F01M 5/001; F01M 25/0735; F01M 25/0737; F01M 25/0731; F28D 7/0066; F28D 2021/0089; F02M 26/30; F02M 26/25; F02M 26/22; F02M 26/13; F01P 2060/04; F01P 3/20
USPC ..... 123/568.12, 41.01, 41.31, 41.33, 196 AB,123/542; 60/273; 701/108
See application file for complete search history.

(56) References Cited

U.S. PATENT DOCUMENTS 4,391,235 A * 7/1983 Majkrzak ..... F02N 19/10 123/142.5 R
4,424,775 A * 1/1984 Mayfield, Jr. ..... F01M 5/001 123/142.5 R
D278,140 S * 3/1985 Tatum ..... D13/179
(Continued)

FOREIGN PATENT DOCUMENTS

JP 2001-132556 A 5/2001
JP 2012-62850 A 3/2012
(Continued)

*Primary Examiner* — Stephen K Cronin
*Assistant Examiner* — Susan E Scharpf
(74) *Attorney, Agent, or Firm* — Morgan, Lewis & Bockius LLP

(57) ABSTRACT

A cooling apparatus for EGR gas and engine oil may include coolant lines through which coolant circulates, an EGR heat exchange part provided between the coolant lines, wherein the EGR gas circulates through the EGR heat exchange part so as to exchange heat with the coolant, a bypass part spaced apart from the EGR heat exchange part, wherein the EGR gas circulates through the bypass part, or bypasses the bypass part so as not to exchange heat with the EGR heat exchange part, an oil heat exchange part provided on the coolant lines and spaced apart from the EGR heat exchange part, wherein engine oil circulates through the oil heat exchange part so as to exchange heat with the coolant, and a control valve provided at an entrance side of the EGR heat exchange part so as to control circulation of the EGR gas into the oil heat exchange part.

10 Claims, 4 Drawing Sheets

(56) References Cited

U.S. PATENT DOCUMENTS 4,685,430 A * 8/1987 Ap ..... F01M 5/00 123/142.5 R
5,617,726 A * 4/1997 Sheridan ..... F02B 37/007 123/568.12
5,893,411 A * 4/1999 Nir ..... F22B 3/04 122/7 R
7,182,074 B1 * 2/2007 Redon ..... F01M 5/002 123/184.21
7,185,642 B1 * 3/2007 Redon ..... F01P 3/12 123/184.21
7,614,389 B2 * 11/2009 Ruckwied ..... F01N 3/2889 123/568.12
7,717,164 B2 * 5/2010 Richter ..... F01M 5/002 165/167
8,205,443 B2 * 6/2012 Pegg ..... F01M 5/001 165/276
2007/0125527 A1 * 6/2007 Flik ..... F02B 29/0412 165/140
2008/0251242 A1 * 10/2008 Irmler ..... F02M 25/0735 165/164
2008/0264609 A1 * 10/2008 Lutz ..... F02M 25/0727 165/104.19
2009/0120387 A1 * 5/2009 Moon ..... F02F 1/16 123/41.72
2011/0094483 A1 * 4/2011 Suh ..... F01M 5/001 123/568.12
2011/0131961 A1 * 6/2011 Lee ..... F01M 5/001 60/320
2012/0144814 A1 * 6/2012 Won ..... F01M 5/001 60/320
2013/0146263 A1 * 6/2013 Kim ..... F28D 7/0041 165/155
2015/0176445 A1 * 6/2015 Han ..... F01M 5/001 123/568.12

FOREIGN PATENT DOCUMENTS

KR 10-2004-0054193 A 6/2004
KR 10-2004-0081898 A 9/2004
KR 10-2006-0022782 A 3/2006
KR 10-1016191 B1 2/2011

* cited by examiner

COOLING APPARATUS AND COOLING CONTROL METHOD FOR EGR GAS AND ENGINE OIL

CROSS REFERENCE TO RELATED APPLICATION

The present application claims priority to Korean Patent Application No. 10-2013-0095238 filed on Aug. 12, 2013, the entire contents of which is incorporated herein for all purposes by this reference.

BACKGROUND OF THE INVENTION

Field of the Invention

The present invention relates to a cooling apparatus and cooling control method for exhaust gas recirculation (EGR) gas and engine oil, in which an EGR cooler for cooling EGR gas and an oil cooler for cooling engine oil are integrated into one module, by which EGR gas can be cooled and engine oil can be heated and cooled.

Description of Related Art

An exhaust gas recirculation (EGR) cooler is an apparatus which reduces the amount of NOx by lowering the temperature of hot EGR gas and an oil cooler is an apparatus which cools oil so that the temperature of oil can stay at a suitable level. The EGR cooler and the oil cooler are very important heat exchangers of an engine.

Coolant (antifreezing solution) performs a very important role in the control over the temperature of fluids or gas through heating and cooling. In particular, the coolant in the oil cooler serves to maintain the temperature of oil at a certain level adequate to operation of the engine. The engine oil is a very important lubricating element for kinematic friction systems in the engine which require lubrication, including an oil pump, a cylinder block, a piston, a crankshaft and most parts of the engine. When the temperature of the oil is low, the friction among these components is worsened due to the low kinematic viscosity of the oil. Accordingly, in a cooling state while the vehicle is being driven, a rapid rise in the temperature of the oil can reduce frictional force, thereby contributing to an improvement in the fuel efficiency of the vehicle.

In addition, the EGR cooler is a very important apparatus for reducing the amount of exhaust (NOx). The coolant has the first role of lowering the temperature of the EGR gas by absorbing the high-temperature heat of the EGR gas. When the coolant is introduced into the oil cooler during cooling, it can perform the second role of raising the temperature of the oil by transferring the heat to the oil.

However, the source of heat required for raising the temperature of the engine oil is the energy of combustion gas (including EGR gas). Heat transferred from the combustion gas can be regarded as the most important factor to raise the temperature of the coolant and the oil. Therefore, there may be a variety of methods that can more rapidly raise the temperature of fluid using the heat of the engine. It is possible to help raise combustion efficiency and fuel efficiency to be optimal levels by controlling the temperatures of the EGR gas, the coolant and the oil.

Referring to FIG. 1, in the related art, an EGR cooler 1 and an oil cooler 2 form separate cooling systems. EGR gas is cooled through the EGR cooler 1 or bypasses the EGR cooler 1 before being discharged depending on the control condition. Coolant constantly flows to the EGR cooler 1, and after having passed through the cooler, forms a cooling circuit that leads to the oil cooler 2.

Oil is taken into and discharged from an oil pump 4 before entering the oil cooler 2 where the oil is cooled. Afterwards, the cooled oil passes through an oil filter 5 and forms a lubricating circuit which leads to an apparatus which requires lubrication.

Although the EGR cooler 1 and the oil cooler 2 indirectly exchange heat via the coolant, it takes a long time to raise the oil temperature during cooling, and the discharge pressure of the oil pump 4 is increased. Consequently, the pressure of the oil, the surface pressure of friction systems, and the friction force of a driving system are increased, which are problematic. The oil having a low temperature forms high kinematic viscosity and high oil pressure, which decreases the friction resistance of engine components and causes noise, thereby decreasing the endurance of the engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cooling apparatus and cooling control method for EGR gas and engine oil, in which an EGR cooler and an engine oil cooler are integrated into one compact structure, and the temperature of an engine oil is rapidly raised, whereby friction in operation of an engine can be reduced and fuel efficiency can be improved.

In an aspect of the present invention, a cooling apparatus for EGR gas and engine oil may include coolant lines through which coolant circulates, an EGR heat exchange part provided between the coolant lines, wherein the EGR gas circulates through the EGR heat exchange part so as to exchange heat with the coolant, a bypass part spaced apart from the EGR heat exchange part, wherein the EGR gas circulates through the bypass part, or bypasses the bypass part so as not to exchange heat with the EGR heat exchange part, an oil heat exchange part provided on the coolant lines and spaced apart from the EGR heat exchange part, wherein engine oil circulates through the oil heat exchange part so as to exchange heat with the coolant, and a control valve provided at an entrance side of the EGR heat exchange part so as to control circulation of the EGR gas into the oil heat exchange part.

The coolant lines are configured so as to pass first through the EGR heat exchange part in order to allow heat exchange between the EGR gas and the coolant and then through the oil heat exchange part in order to allow heat exchange between the engine oil and the coolant.

The EGR heat exchange part may include the coolant lines which crosses a passage through which the EGR gas circulates and a plurality of cooling fins which connect the coolant lines with each other.

The control valve is provided at the entrance side of the EGR heat exchange part, and is controlled to be opened or closed so that the EGR gas circulates through the EGR heat exchange part or the bypass part in accordance with operation of the control valve.

The cooling apparatus may further include a bypass valve provided at an entrance side of the bypass part, wherein the bypass valve is controlled to be opened or closed so that the EGR gas circulates through the bypass part in accordance with operation of the bypass valve.

The control valve and the bypass valve alternately operate so as not to be concurrently opened or closed.

The oil heat exchange part may include an oil passage through which the engine oil circulates, a coolant passage connected to the coolant lines and through which the coolant circulates, and an EGR gas passage through which the EGR gas circulates, wherein the oil passage, the coolant passage and the EGR gas passage are stacked on each other so that heat is exchanged therebetween.

The oil heat exchange part may include a plurality of oil passages, a plurality of coolant passages, and a plurality of EGR gas passages which are sequentially stacked on each other.

A connecting passage is provided at an entrance side of the bypass part and connected to the EGR gas passages such that the EGR gas that circulates through the bypass part circulates through the EGR gas passages of the oil heat exchange part.

The cooling apparatus may further include an gas valve provided at an exit side of the bypass part, wherein the gas valve is controlled to be opened or closed so that the EGR gas flows through the connecting passage and circulates through the EGR gas passages of the oil heat exchange part when the gas valve is closed.

The cooling apparatus may further include a case, wherein the case may include an inlet channel part through which the EGR gas is introduced and an outlet channel part through which the EGR gas is discharged, and the coolant lines are provided inside the case, and the EGR heat exchange part, the bypass part and the oil heat exchange part are connected between the inlet channel part and the outlet channel part so that the EGR gas circulates.

In another aspect of the present invention, a method of controlling the cooling apparatus for the EGR gas and the engine oil may include a bypass mode of closing the control valve and opening the bypass valve and the gas valve when a temperature of the EGR gas is determined to be low so that the EGR gas passes through the bypass part, an EGR cooling mode of opening the control valve and closing the bypass valve and the gas valve when the temperature of the EGR gas is determined to be high so that the EGR gas passes through the EGR heat exchange part, and an oil heating mode of closing the control valve and the gas valve and opening the bypass valve when a rise in the temperature of the engine oil is determined to be necessary so that the EGR gas passes through the oil heat exchange part through a connecting passage connecting the bypass part to the oil heat exchange part.

It is determined that the temperature of the EGR gas is low and the bypass mode is carried out when the temperature of the coolant is lower than a first reference value, and it is determined that the temperature of the EGR gas is high and the EGR cooling mode is carried out when the temperature of the coolant is higher than the first reference value.

The oil heating mode is performed when the temperature of the coolant is higher than the first reference value and the temperature of the engine oil is lower than a second reference value.

The method may further include checking a temperature of the engine oil, wherein it is determined that the temperature of the engine oil is required to be raised and the oil heating mode is carried out when the temperature of the engine oil is lower than a second reference value.

According to the cooling apparatus and cooling control method for EGR gas and engine oil configured as above, the EGR cooler and the engine oil cooler are integrated into one compact structure, and the temperature of the engine oil is rapidly raised. Consequently, it is possible to reduce friction in operation of the engine and improve fuel efficiency.

In addition, it is possible to decrease wear and increase fatigue limit by reducing the driving force of the oil pump and realizing proper lubricating ability. Since the temperature of the oil is rapidly raised to the optimum lubricating state, it is possible to reduce noise and vibration caused by operation of the engine.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
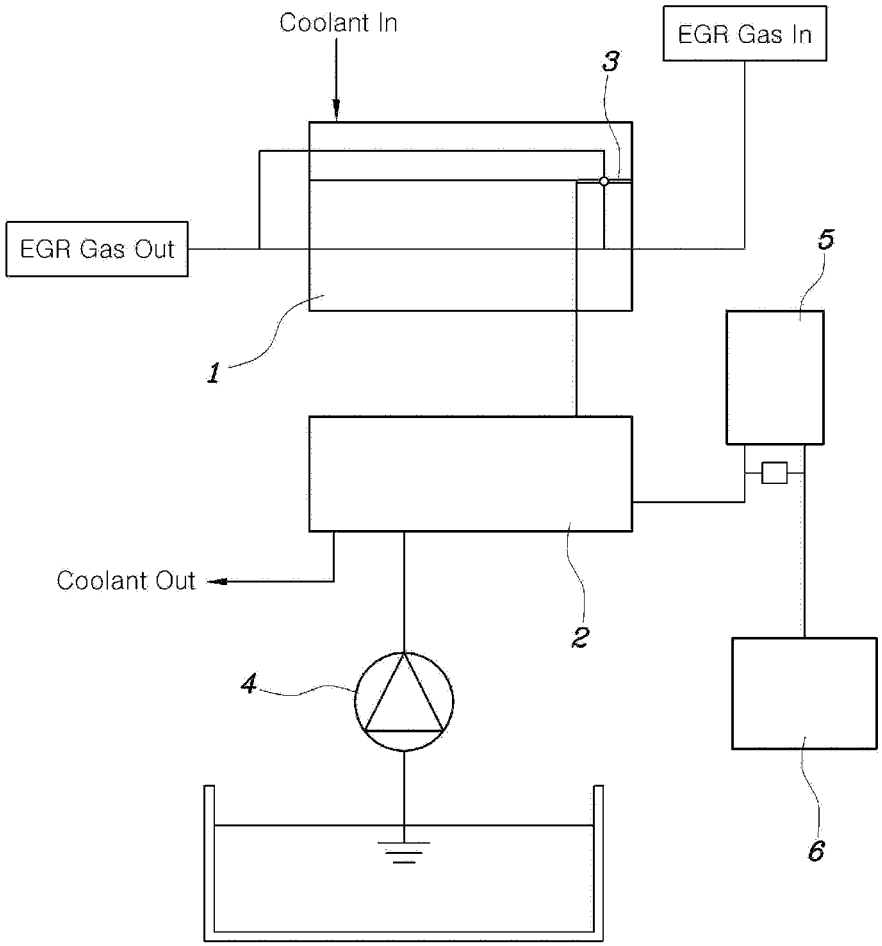
FIG.1 (Related Art)
FIG. 1 is a configuration view showing an EGR cooler and an engine oil cooler of the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in greater detail to a cooling apparatus and cooling control method for EGR gas and engine oil of the present invention, exemplary embodiments of which is illustrated in the accompanying drawings. Wherever possible, the same reference numerals will be used throughout the drawings and the description to refer to the same or like parts.

Figure 2:
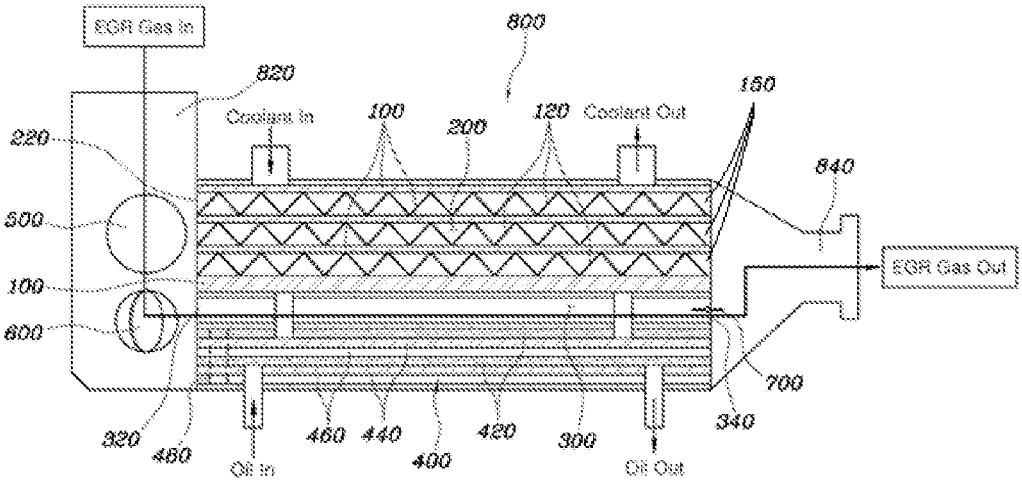
FIG. 2 is a configuration view showing a cooling apparatus for EGR gas and engine oil according to an exemplary embodiment of the present invention.
Figure 3:
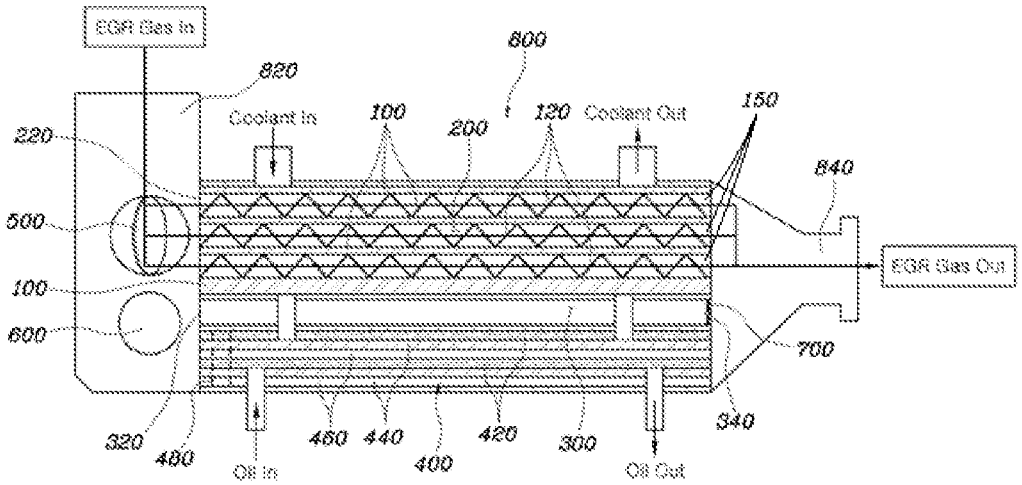
FIG. 3 and FIG. 4 are views showing the operating state of the cooling apparatus for EGR gas and engine oil shown in FIG. 2.
Figure 4:
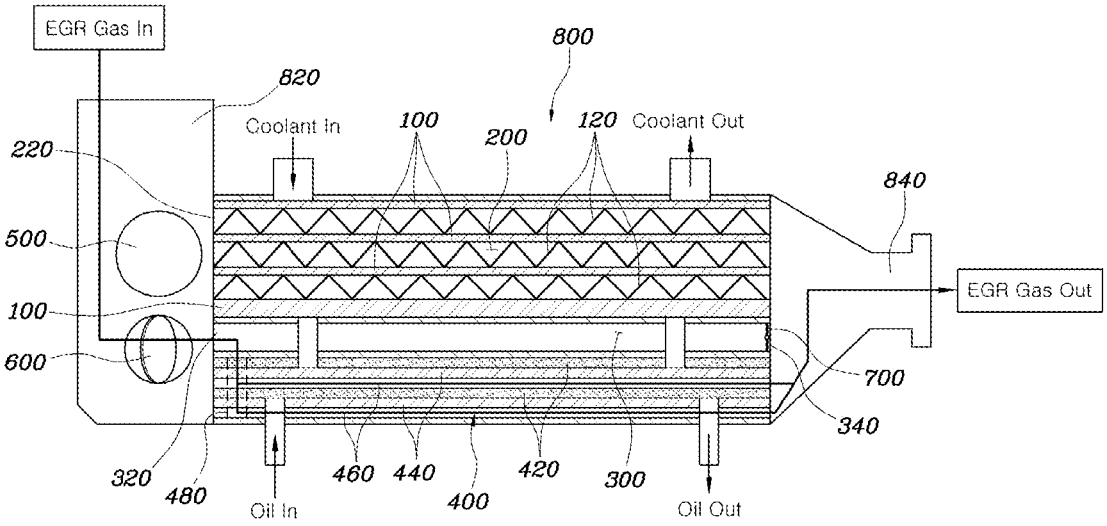
Figure 5:
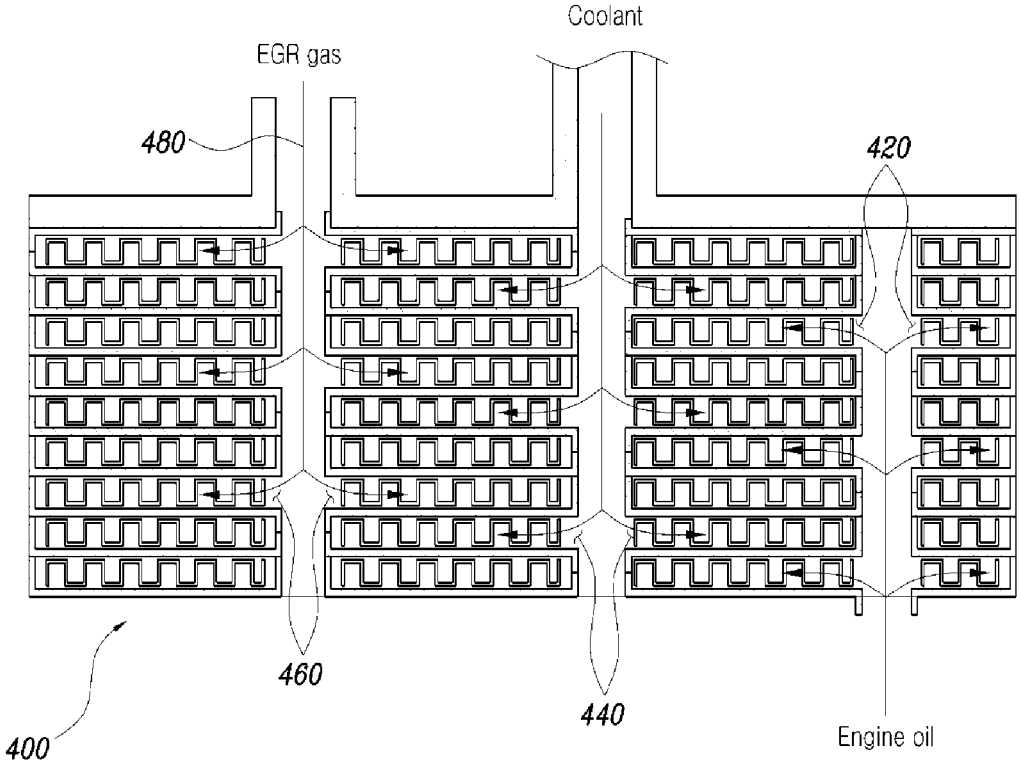
FIG. 5 is a view showing the heat exchange part of the cooling apparatus for EGR gas and engine oil shown in FIG. 2.
Figure 6:
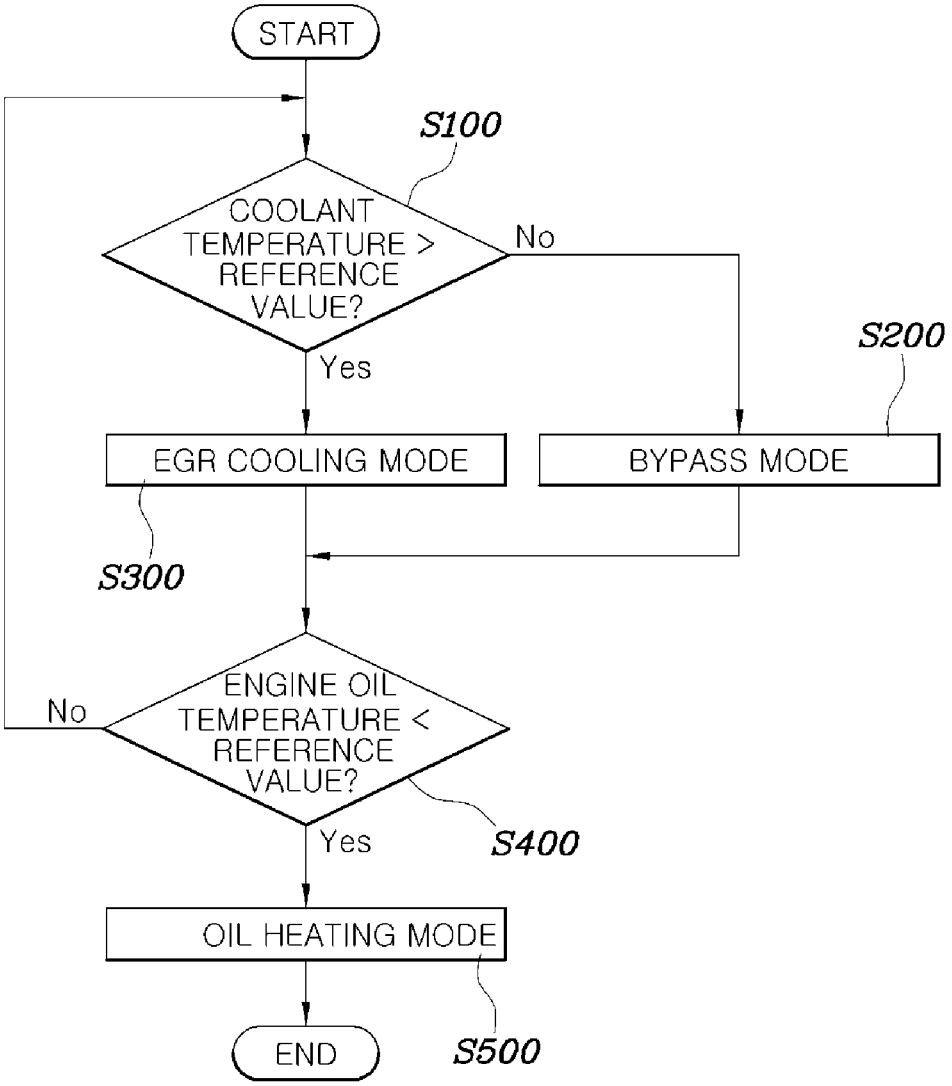
FIG. 6 is a flowchart showing a cooling control method for EGR gas and engine oil according to an exemplary embodiment of the present invention.

FIG. 2 is a configuration view showing a cooling apparatus for EGR gas and engine oil according to an exemplary embodiment of the present invention, and FIG. 5 is a view showing the heat exchange part of the cooling apparatus for EGR gas and engine oil shown in FIG. 2. The operating state of the present invention is shown in FIG. 2 to FIG. 4.

The cooling apparatus for EGR gas and engine oil according to the present exemplary embodiment includes coolant lines 100, an EGR heat exchange part 200, a bypass part 300, an oil heat exchange part 400 and a control valve 500. Coolant circulates through the coolant lines 100. The EGR heat exchange part 200 is provided on the coolant lines 100, and EGR gas circulates through the EGR heat exchange part 200 so as to exchange heat with the coolant. The bypass part 300 is spaced apart from the EGR heat exchange part 200. The EGR gas circulates through the bypass part 300, or bypasses the bypass part 300 so as not to exchange heat with the EGR gas. The oil heat exchange part 400 is provided on the coolant lines 100 so as to be spaced apart from the EGR heat exchange part 200, and engine oil circulates through the oil heat exchange part 400 so as to exchange heat with the coolant. The control valve 500 is provided at an entrance side of the EGR heat exchange part 400 so as to control circulation of the EGR gas.

According to this embodiment, an EGR cooler and an oil cooler are integrated into one module, in which the EGR heat exchange part 200 which allows heat exchange between the EGR gas and the coolant and the oil and the oil heat exchange part 400 which allows heat exchange between the engine oil and the coolant are provided on the coolant lines 100. Also provided is the bypass part 300 through which the EGR gas circulates without heat exchange with the coolant. When heat exchange in addition to heating and cooling of the engine oil is not required, the EGR gas can bypass the bypass part 300. Accordingly, the condition of the EGR gas and the engine oil can be properly controlled as required.

Specifically describing the present invention, the coolant lines 100 can be provided such that they pass first through the EGR heat exchange part 200 in order to allow heat exchange between the EGR gas and the coolant and then through the oil heat exchange part 400 in order to allow heat exchange between the engine oil and the coolant.

In general, when hot EGR gas is reduced, some problems may occur, i.e. the endurance of components may be decreased by being damaged by heat or the amount of NOx may be increased. In addition, when the engine oil has a low temperature, there may be a problem in that high kinematic viscosity increases frictional force so that the operation of an engine is deteriorated.

Therefore, it is preferable that the coolant lines 100 pass through the EGR heat exchange part 200 and then the oil heat exchange part 400. Due to this configuration, first, the coolant that circulates through the coolant lines 100 absorbs high-temperature heat of the EGR gas through heat exchange between the coolant and the EGR gas in the EGR heat exchange part 200. Afterwards, the coolant having high temperature is introduced into the oil heat exchange part to transfer high-temperature heat of the coolant to the engine oil, thereby raising the temperature of the engine oil.

Since the coolant line is configured as above, it is possible to reduce damage to the components and the amount of NOx that is produced by lowering the temperature of the EGR gas while improving the fuel efficiency of a vehicle by reducing frictional force in operation of the engine due to the rapid rise in the temperature of the engine oil.

In addition, the EGR heat exchange part 200 includes a plurality of coolant lines 100 which crosses a passage through which the EGR gas circulates and a plurality of cooling fins 120 which connect the coolant lines 100 with each other.

Since the EGR heat exchange part 200 includes the plurality of coolant lines 100 and the cooling fins 120 which connect the coolant lines 100, heat exchange between the EGR gas that circulates through the EGR heat exchange part 200 and the coolant can be more activated. Due to this structure, heat exchange between the EGR gas and the coolant can be activated such that the coolant absorbs a sufficient amount of high-temperature heat of the EGR gas, thereby preventing the components from being damaged by the hot EGR gas and reducing the amount of NOx that is produced.

In addition, the control valve 500 can selectively control the direction in which the EGR gas circulates depending on the necessity of cooling of the EGR gas when the EGR gas circulates through the EGR heat exchange part 200 or the bypass part 300. The control valve 500 is provided at the entrance side of the EGR heat exchange part 200 such that it can be selectively opened or closed so that the EGR gas can selectively circulate through the EGR heat exchange part 200 or the bypass part 300. Furthermore, a bypass valve 600 is provided at the entrance side of the bypass part 300 such that it can be selectively opened or closed so that the EGR gas circulates through the bypass part 300.

Here, the control valve 500 and the bypass valve 600 must alternately operate so that they do not perform the same operation while being opened or closed, when both the control valve 500 and the bypass valve 600 perform the opening operation, the EGR gas does not circulate. This may cause an overload, thereby creating an error in the operation, when both the control valve 500 and the bypass valve 600 perform the closing operation, the EGR gas may not be efficiently cooled.

Accordingly, the control valve 500 and the bypass valve 600 are configured so as not to perform the same operation when being opened or closed, thereby preventing an error in the operation. This also allows the EGR gas to selectively circulate through the EGR heat exchange part 200 or the bypass part 300 when cooling of the EGR gas is required.

Briefly describing the operating state of the control valve 500 and the bypass valve 600, when it is required to cool the EGR gas, the control valve 500 is opened and the bypass valve 600 is closed so that the EGR gas circulates through the EGR heat exchange part 200. Then, the temperature of the EGR gas can be lowered through heat exchange between the EGR gas and the coolant. When it is not required to lower the temperature of the EGR gas to a suitable level, the control valve 500 can be closed and the bypass valve 600 can be opened so that the EGR gas does not circulate through the EGR heat exchange part 200 but is discharged through the bypass part 300 without heat exchange with the coolant.

The operating state of the control valve 500 and the bypass valve 600 will be described in more detail together with an gas valve 700 which will be described later.

In addition, the oil heat exchange part 400 can be configured such that an oil passage 420 through which the engine oil circulates, a coolant passage 440 through which the coolant circulates, and an EGR gas passage 460 through which the EGR gas circulates are stacked on each other so that heat is exchanged among them.

In the oil heat exchange part 400, it is preferable that a plurality of oil passages 420, a plurality of coolant passages 440 and a plurality of EGR passages 460 are sequentially stacked on each other so that heat is efficiently exchanged among the engine oil that circulates through the oil passages 420, the coolant that circulates through the coolant passages 440, and the EGR gas that circulates through the EGR gas passages 460.

According to the present exemplary embodiment of the present invention, the oil heat exchange part 400 is provided with the oil passages 420 through which the engine oil circulates and the coolant passage 440 through which the coolant circulates. Here, the coolant passage 440 is connected to the coolant lines 100. As described above, the coolant lines 100 are configured such that the coolant passes through the EGR heat exchange part 200 before passing through the coolant passage 440 of the oil heat exchange part 400.

As such, the coolant lines 100 pass through first the EGR heat exchange part 200 such that the coolant is raised in temperature by absorbing high-temperature heat through heat exchange with the EGR gas. Then, the heated coolant enters the coolant passages 440 of the oil heat exchange part 400 to raise the temperature of the engine oil or maintain the engine oil at a certain temperature.

In addition, the oil heat exchange part 400 is also provided with the EGR gas passages 460 through which the EGR gas circulates. Here, the oil heat exchange part 400 can be provided with a connecting passage 480 at the side of the entrance 320 of the bypass part 300 such that the EGR gas circulates through the EGR gas passages 460. In this fashion, the EGR gas that circulates through the bypass part 300 can circulate through the EGR gas passages 460 of the oil heat exchange part 400.

Since the EGR gas flows toward the EGR gas passages 460 of the oil heat exchange part 400 through the connecting passage 480 in this fashion, the temperature of the engine oil can be caused to be rapidly raised by the hot EGR gas that circulates through the EGR gas passages 460. This can rapidly realize the lubrication performance of the engine oil, thereby reducing friction during operation of the engine and improving fuel efficiency.

Here, the gas valve 700 is provided such that the EGR gas of the oil heat exchange part 400 circulates to the EGR gas passages 460 through the connecting passage 480. The gas valve 700 is provided at the side of an exit 340 of the bypass part 300 such that it is opened and closed so that the EGR gas circulates through the connecting passage 480.

Specifically, according to the present exemplary embodiment of the present invention, the connecting passage 480 is formed on the side of the entrance 320 of the bypass part 300. When the bypass part 300 is closed through the gas valve 700, the EGR gas is not discharged through the bypass part 300. Due to this configuration, the EGR gas can move toward the EGR gas connecting passage 480.

More specifically, the operating state of the present invention using the above-described valves, including the control valve 500, the bypass valve 600 and the gas valve 700, will be described with reference to FIGS. 2 to 4.

FIG. 2 shows that the EGR gas passes through the bypass part 300. This can be used in the case of supplying the coolant that does not exchange heat with the EGR gas to the oil heat exchange part 400 when cooling is not required as the temperature of the EGR gas is at a suitable level or cooling is required as the temperature of the engine oil has rapidly risen.

In this circumstance, the control valve 500 is closed so that the EGR gas does not circulate to the EGR heat exchange part 200, and the bypass valve 600 and the gas valve 700 are opened so that the EGR gas circulates to the bypass part 300, thereby allowing the EGR gas to be discharged without heat exchange with the coolant. Consequently, the EGR gas having a suitable temperature can be discharged without heat exchange. Since the coolant in the coolant lines 100 do not exchange heat with the EGR gas, it can circulate through the oil heat exchange part 400 while maintaining the low temperature, thereby lowering the temperature of the engine oil.

FIG. 3 shows that the EGR gas passes through the EGR heat exchange part 200. This can be used for heat exchange between the EGR gas and the coolant when cooling of the EGR gas for reducing the production of NOx is required or the temperature of the engine oil is required to be raised or maintained.

In this circumstance, the control valve 500 is opened so that the EGR gas circulates through the EGR heat exchange part 200 via EGR gas passage 150, thereby enabling heat exchange between the EGR gas and the coolant. The bypass valve 600 and the gas valve 700 are closed so that the EGR gas circulates through the EGR heat exchange part 200 but does not circulate through any other passages. That is, the temperature of the EGR gas is lowered as the EGR gas passes through the EGR heat exchange part 200, and the temperature of the coolant is raised, thereby contributing to a rise in the temperature of the engine oil.

In addition, FIG. 4 shows that the EGR gas passes through the oil heat exchange part 400. This can be used when a rapid rise in the temperature of the engine oil is required.

In this circumstance, the control valve 500 is closed so that the EGR gas does not circulate through the EGR heat exchange part 200, and the bypass valve 600 is opened so that the EGR gas circulates through the bypass part 300. Here, since the gas valve 700 provided at the side of the exit 340 is closed, the EGR gas circulates to the EGR gas passages 460 of the heat exchange part 400 through the connecting passage 480, i.e. the only passage formed at the side of the entrance 320 of the bypass part 300. Consequently, the temperature of the engine oil in the oil heat exchange part 400 can be rapidly raised due to heat exchange between the engine oil and the hot EGR gas.

As described above, the direction in which the EGR gas circulates is selectively controlled by opening or closing the respective valves depending on whether cooling or heating of the EGR gas or the engine oil is required. Consequently, it is possible to reduce the amount of NOx that is produced and rapidly realize the lubricating ability of the engine oil.

In addition, also provided is a case 800 which has an inlet channel part 820 through which the EGR gas is introduced and an outlet channel part 840 through which the EGR gas is discharged. The coolant lines 100 are provided inside the case 800. The EGR heat exchange part 200, the bypass part 300 and the oil heat exchange part 400 are connected between the inlet channel part 820 and the outlet channel part 840 such that the EGR gas circulates through these components.

As such, the coolant lines 100 are provided inside the case 800 in which the inlet channel part 820 through which the EGR gas is introduced and the outlet channel part 840 through which the EGR gas is discharged, and the EGR heat exchange part 200, the bypass part 300 and the oil heat exchange part 400 are provided so as to constitute one apparatus. This can consequently improve the ease of installation and the convenience of workers.

In addition, the EGR gas can be efficiently introduced and discharged through the inlet channel part 820 and the outlet channel part 840, and the compactness and assembling ability of the layout can be improved.

Also provided is a control method of the above-described cooling apparatus for EGR gas and engine oil. The cooling control method includes bypass mode S200 of closing the control valve and opening the bypass valve and the gas valve when the temperature of the EGR gas is determined to be low so that the EGR gas passes through the bypass part, EGR cooling mode S300 of opening the control valve and closing the bypass valve and the gas valve when the temperature of the EGR gas is determined to be high so that the EGR gas passes through the EGR heat exchange part, and oil heating mode S500 of closing the control valve and the gas valve and opening the bypass valve when a rise in the temperature of the engine oil is determined to be necessary so that the EGR gas passes through the oil heat exchange part through a connecting passage.

Here, at S100, the temperature of the coolant inside the coolant line is checked. When the temperature of the coolant is lower than a reference value, it is determined that the temperature of the EGR gas is low, and the bypass mode is carried out. When the temperature of the coolant is higher than the reference value, it is determined that the temperature of the EGR gas is high, and the EGR cooling mode can be carried out.

Specifically, when the temperature of the coolant is low, it can be determined that the vehicle is idling or driving at a low speed. In this case, since a large amount of NOx is not produced, the necessity of cooling of the EGR gas can be low. In addition, when the temperature of the coolant is high, it can be determined that the vehicle is driving at high speed. In this case, since the temperature of exhaust gas is high and a large amount of NOx is produced, it is preferable that the EGR gas passes through the EGR heat exchange part in order to lower the temperature of the EGR gas. In addition, the engine oil can be heated using hot coolant while the EGR gas is being cooled.

At S400, the temperature of the engine oil is checked. When the temperature of the engine oil is lower than a reference value, it is determined that the temperature of the engine oil is required to be raised, and the oil heating mode S500 can be carried out.

When the bypass mode or EGR cooling mode is carried out, the temperature of the coolant inside the coolant line is checked and compared with a reference value or the temperature of the EGR gas is checked, so that the bypass mode or the EGR cooling mode can be selectively carried out depending on the temperature of the EGR gas. Furthermore, when the temperature of the engine oil is required to be raised, the temperature of the engine oil can be rapidly raised through the oil heating mode.

Here, reference values of the temperatures of the coolant, the EGR gas and the engine oil can be applied by being properly changed depending on the specification and design of the vehicle.

In addition, according to an exemplary embodiment of the present invention, it is possible to properly control the control valve, the bypass valve and the gas valve to be opened or closed by variously changing the logic when cooling the EGR gas and heating the oil.

According to the cooling apparatus and cooling control method for EGR gas and engine oil configured as above, the EGR cooler and the engine oil cooler are integrated into one compact structure, and the temperature of the engine oil is rapidly raised. Consequently, it is possible to reduce friction in operation of the engine and improve fuel efficiency.

In addition, it is possible to decrease wear and increase fatigue limit by reducing the driving force of the oil pump and realizing proper lubricating ability. Since the temperature of the oil is rapidly raised to the optimum lubricating state, it is possible to reduce noise and vibration caused by operation of the engine.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cooling apparatus for EGR gas and engine oil comprising:

a case including an inlet channel part through which the EGR gas is introduced and an outlet channel part through which the EGR gas is discharged;

a bypass part provided in the case, wherein the EGR gas introduced through the inlet channel part of the case passes through the bypass part so as not to exchange heat with the engine oil or coolant;

an EGR heat exchange part, provided in the case and disposed adjacent to a first side of the bypass part, wherein the EGR heat exchanger includes first EGR gas passages through which the EGR gas introduced through the inlet channel part passes and coolant lines through which the coolant circulates; and an oil heat exchange part provided in the case and disposed adjacent to a second side of the bypass part, wherein the oil heat exchanger includes second EGR gas passages through which the EGR gas introduced through the inlet channel part passes and coolant lines through which the coolant circulates.

2. The cooling apparatus according to claim 1, wherein the EGR heat exchange part includes:

the coolant lines which crosses the first EGR gas passage through which the EGR gas circulates; and a plurality of cooling fins which connect the coolant lines with each other.

3. The cooling apparatus according to claim 1, further comprising a control valve provided at an entrance side of the EGR heat exchange part so as to control circulation of the EGR gas into the oil heat exchange part, wherein the control valve is controlled to be opened or closed so that the EGR gas circulates through the EGR heat exchange part or the bypass part in accordance with operation of the control valve.

4. The cooling apparatus according to claim 3, further comprising a bypass valve provided at an entrance side of the bypass part, wherein the bypass valve is controlled to be opened or closed so that the EGR gas circulates through the bypass part in accordance with operation of the bypass valve.

5. The cooling apparatus according to claim 4, wherein the control valve and the bypass valve alternately operate so as not to be concurrently opened or closed.

6. The cooling apparatus according to claim 1, wherein in the oil heat exchange part the oil passage, the coolant passage and the second EGR gas passage are stacked on each other so that heat is exchanged therebetween.

7. The cooling apparatus according to claim 6, wherein the oil heat exchange part comprises a plurality of oil passages, a plurality of coolant passages, and a plurality of second EGR gas passages which are sequentially stacked on each other.

8. The cooling apparatus according to claim 6, wherein a connecting passage is provided at an entrance side of the bypass part and connected to the second EGR gas passages such that the EGR gas that circulates through the bypass part circulates through the second EGR gas passages of the oil heat exchange part.

9. The cooling apparatus according to claim 8, further comprising an gas valve provided at an exit side of the bypass part, wherein the gas valve is controlled to be opened or closed so that the EGR gas flows through the connecting passage and circulates through the second EGR gas passages of the oil heat exchange part when the gas valve is closed.

10. The cooling apparatus according to claim 1, wherein the EGR heat exchange part, the bypass part and the oil heat exchange part are connected between the inlet channel part and the outlet channel part so that the EGR gas circulates.

* * * * *